US005498175A

United States Patent [19]

Yeh et al.

[11] Patent Number: 5,498,175

[45] Date of Patent: Mar. 12, 1996

[54] COAXIAL CABLE CONNECTOR

[76] Inventors: Ming-Hwa Yeh; Shen-Chia Wong, both of No. 10, Lane 121, Li-Der Rd., Peito District, Taipei, Taiwan

[21] Appl. No.: 177,949

[22] Filed: Jan. 6, 1994

[51] Int. Cl.[6] ..... H01R 9/05

[52] U.S. Cl. ..... 439/578; 439/276; 439/638

[58] Field of Search ..... 439/578, 659, 439/638, 675, 426, 276

[56] References Cited

U.S. PATENT DOCUMENTS

| | | | |
|---|---|---|---|
| 3,111,356 | 11/1963 | Mazzagatti | 439/638 |
| 3,161,453 | 12/1964 | Powell | 439/578 |
| 3,206,540 | 9/1965 | Cohen | 439/578 |
| 3,437,982 | 4/1969 | O'Keefe | 439/578 |
| 4,035,054 | 7/1977 | Lattanzi | 439/578 |
| 4,373,767 | 2/1983 | Cairns | 439/578 |
| 4,425,017 | 1/1984 | Chan | 439/276 |
| 4,687,279 | 8/1987 | Holland | 439/638 |
| 5,096,444 | 3/1992 | Lu | 439/578 |
| 5,295,864 | 3/1994 | Birch | 439/578 |

*Primary Examiner*—Kurt Rowan
*Attorney, Agent, or Firm*—Lowe, Price, LeBlanc & Becker

[57] ABSTRACT

A coaxial cable connector including a main body containing a contact member and two insulating members fitted with the contact member, with each insulating member composed of an insulating sleeve, a resilient member and an insulating cap. The stretching ability of a cable conductor inserted into the contact portion of the contact member is limited by the resilient member and an extra resilient compressing force is exerted on the contact surface to provide improved contacting effect with coaxial cables having conductors of different diameters.

3 Claims, 8 Drawing Sheets

COAXIAL CABLE CONNECTOR

BACKGROUND OF THE INVENTION

The present invention relates to an improved coaxial cable connector, and more particularly to a coaxial cable connector including a main body, a rod-like contact member and two insulating members fitted with the contact member. The insulating member is composed of an insulating sleeve, a resilient member and an insulating cap. When the cable conductor is inserted into the contact portions of the contact member through the opening, the stretching ability of the cable conductor is limited by the resilient member and an extra resilient compressing force is exerted on the contact surface so as to be applicable to coaxial cables with different specifications (ϕ 0.5 mm to ϕ 1.2 mm) and reduce return loss.

In the conventional cable television systems (CATV), subscription television systems (STV) and master antenna television systems (MATV), the coaxial cable is used to transmit signals. At present, the used frequency is required to be higher and higher. The frequency has been increased from 550 MHz to 1000 MHz or higher. Therefore, the quality of the coaxial cable will directly affect the quality of the visual signal. Especially, as shown in FIG. 1, the currently commercially available coaxial cable connector 60 includes an inner plat contact plate 61, so that when the cable core is inserted thereinto, the cable conductor only contacts with the contact plate 61 at an upper and a lower points. Such contacting effect is poor and the tested return loss is greater. Therefore, such connector is not suitable for high frequency requirement and the quality thereof cannot be actually controlled.

For solving the above problems, a circular pin structure is designed according to impedance matching formula as follows:

$$Zo = \frac{138}{\sqrt{\epsilon}} \log\left(\frac{D}{d}\right)$$

wherein:

$Z_o$=impedance matching, $\epsilon$=dielectric constant of material,

D=diameter of large circle and d =diameter of small circle.

Therefore, it is known from the formula that a circle is the best impedance matching. Because the impedance matching of the flat contact plate cannot be calculated and in the CATV, the main line and branch line use different coaxial cables (such as Nos. RG59, RG6, etc.), it is necessary to provide an improved coaxial cable connector to solve the problems of impedance matching in high frequency and the mutuality of different cables. Also, a coaxial cable connector with good contacting effect and little return loss is required.

SUMMARY OF THE INVENTION

It is a primary object of the present invention to provide an improved coaxial cable connector which includes a main body, a contact member and two insulating members fitted with the contact member. The insulating member is composed of an insulating sleeve, a resilient member and an insulating cap. When the cable conductor is inserted into the contact portions of the contact member through the opening, the stretching ability of the cable conductor is limited by the resilient member and an extra resilient compressing force is exerted on the contact surface so as to be applicable to coaxial cables with different specifications (ϕ 0.5 mm to ϕ 1.2 mm) and reduce return loss.

It is a further object of the present invention to provide the above connector in which two ends of the contact member can be symmetrically or asymmetrically designed for applying to different coaxial cables with different structures.

It is still a further object of the present invention to provide the above connector in which the contact member is formed with several slots and a resilient member is fitted on the contact member to bind the slots so as to achieve wider applicability to coaxial cable conductors with various dimensions.

The present invention can be best understood through the following description and accompanying drawing, wherein:

DETAILED DESCRIPTION OF THE PREFERRED EMBODIMENTS

Figure 1:
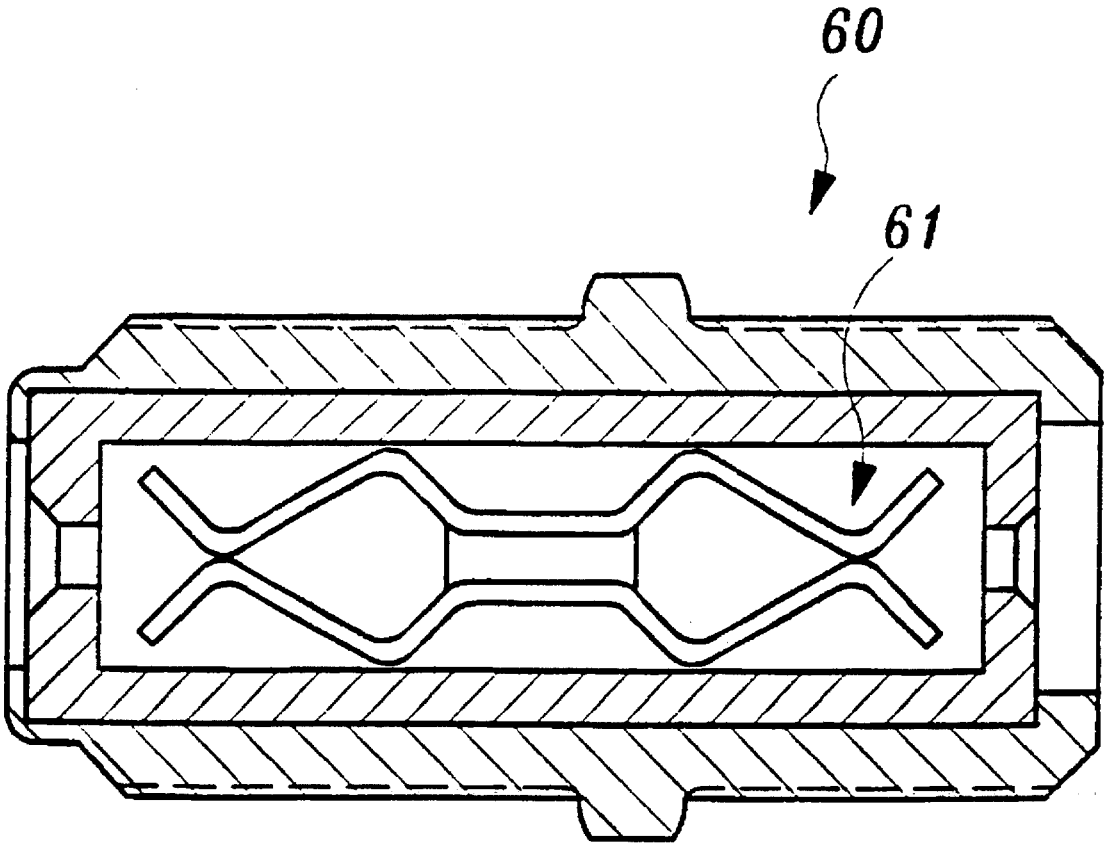
FIG. 1 PRIOR ART
FIG. 1 is a sectional view of a conventional coaxial cable connector.
Figure 2:
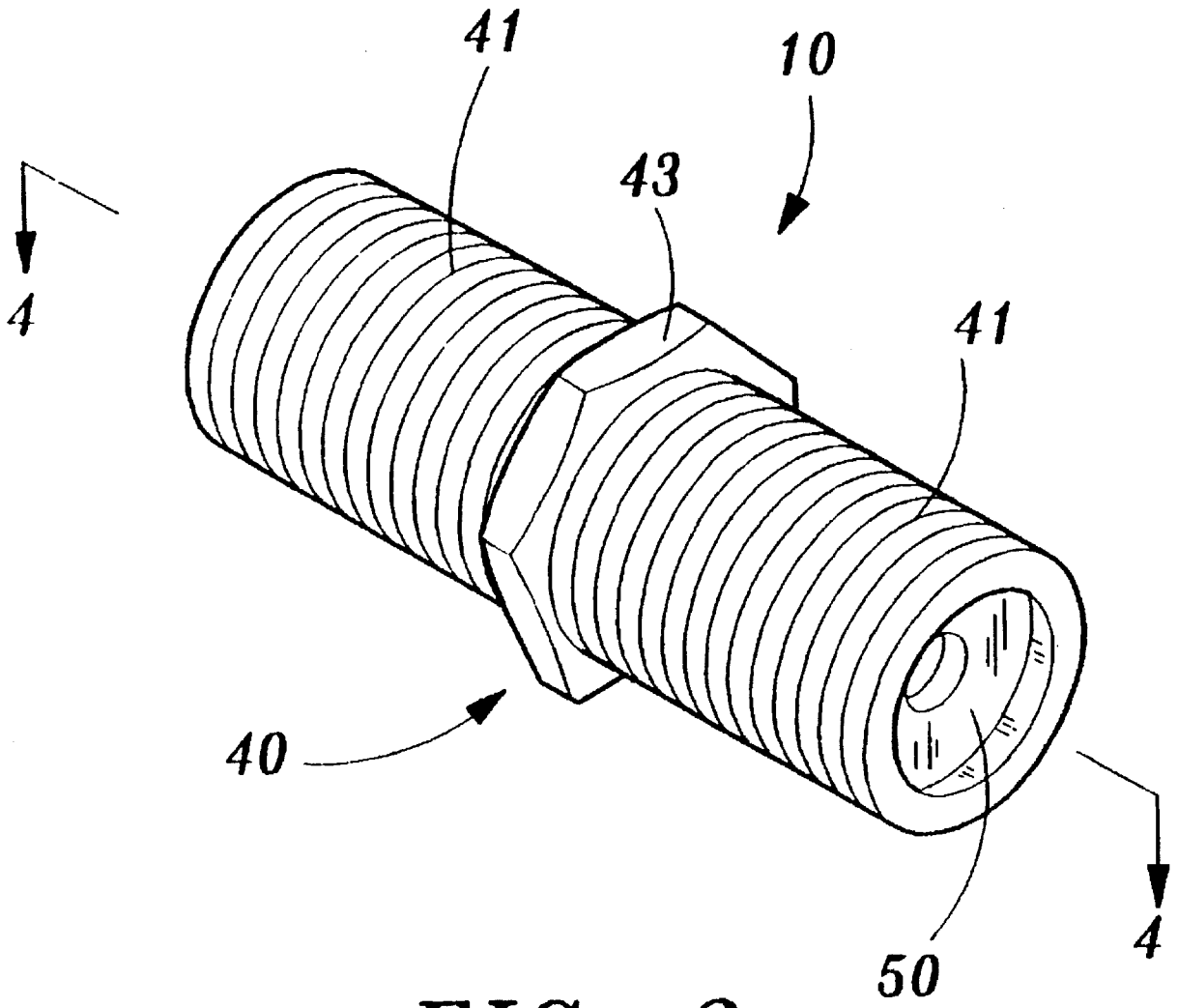
FIG. 2 is a perspective view of a first embodiment of the present invention.

Please refer to FIGS. 2, 3, 4, 5 and 5A. The coaxial cable connector 10 of the present invention includes a main body 40, a contact member 20 and two insulating members 53 received in the main body 40, wherein the main body 40 is a conventional hollow member and formed with a middle annular partitioning section 43 which projects outward and divides the main body 40 into two portions each of which is formed with outer thread 41. The outer thread 41 is suitable to be screwed with the inner thread of an output or an input terminal. The contact member 20 has a symmetrical structure and a pair of projecting wings 21 are formed on a middle section of the contact member 20. Four slots 22 are formed on each sleeve-like end of the contact member 20. The slots 22 divide the sleeve-like end of the contact member 20 into four contacting portions 23. An inward projecting section 24 is formed near a tail end of each contact portion 23.

Figure 3:
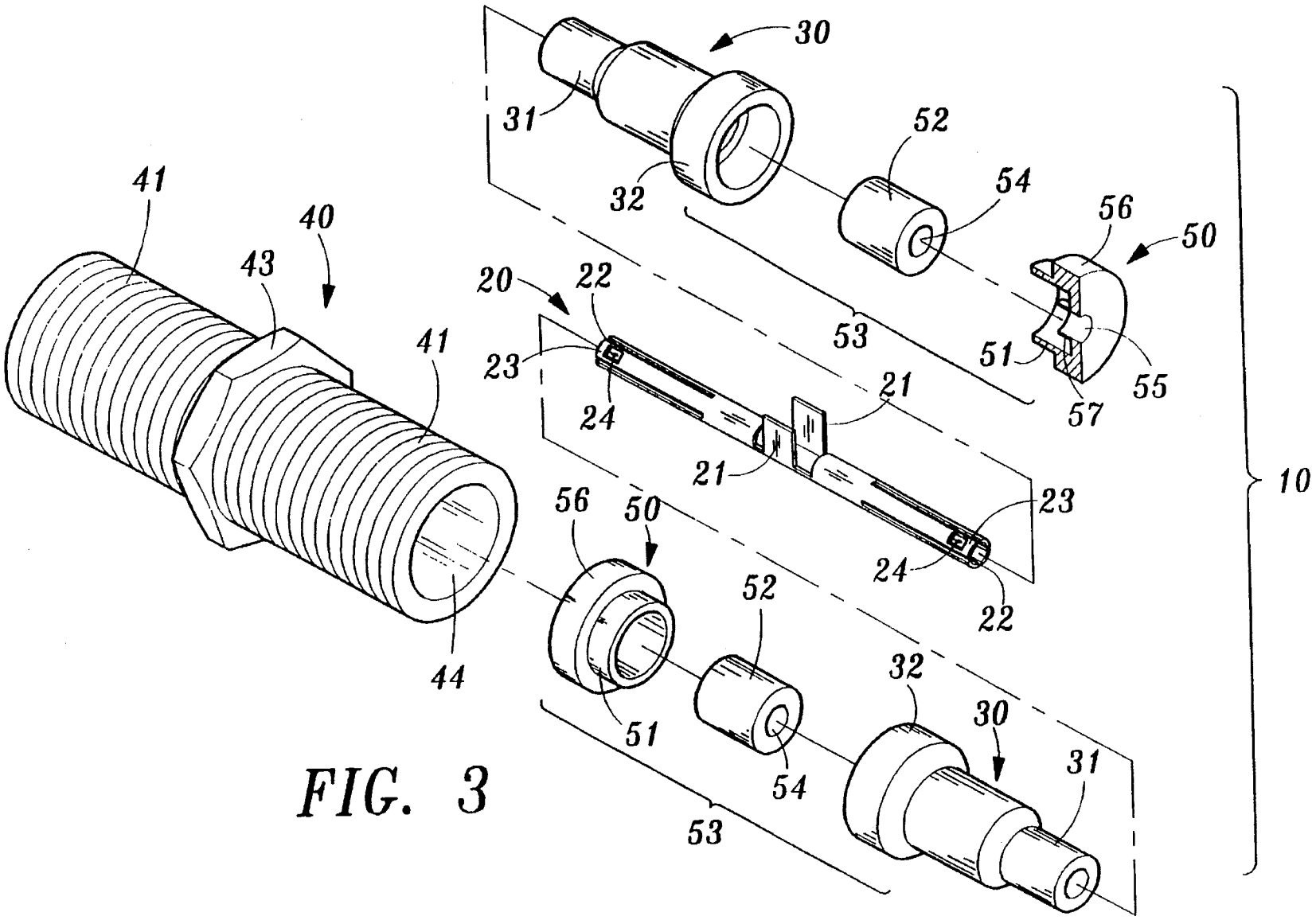
FIG. 3 is a perspective exploded view according to FIG. 2.

Please refer to FIG. 3. The insulating member 53 is composed of an insulating sleeve 30, a resilient member 52 and an insulating cap 50, wherein the insulating sleeve 30 is a three-stage hollow cylindric member, and the resilient member 52 is made of silicone material or the like and is sleeve-shaped. A central axial through hole 54 is formed on the resilient member 52. The insulating cap 50 is a two-stage hollow cylindric member and formed with a central axial opening 55. An inner flange 57 is formed on inner side of the opening 55, whereby when the cable conductor is inserted into the opening 55, the inner flange 57 is able to guide the cable conductor. The resilient member 52 is placed into the insulating cap 50 with one side of the resilient member 52 abutting against the inner flange 57. Then, the assembled insulating cap 50 and resilient member 52 are placed into a larger diameter end 32 of the insulating sleeve 30 in such a manner that the smaller diameter end 51 of the insulating cap 50 is placed into the larger diameter end 32 of the insulating sleeve 30 to form a combination.

Figure 4:
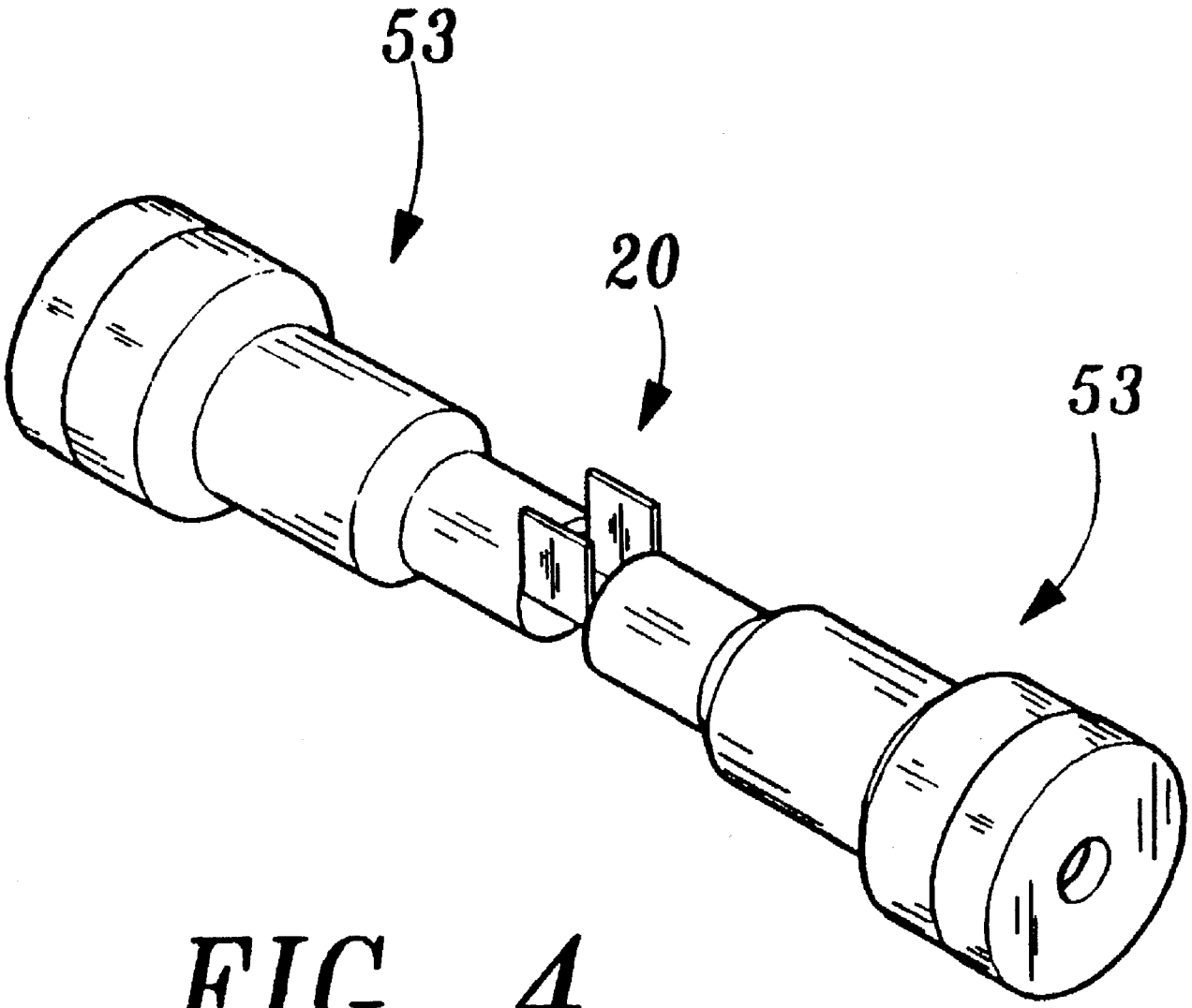
FIG. 4 shows the assembled contact member and insulating member.
Figure 5:
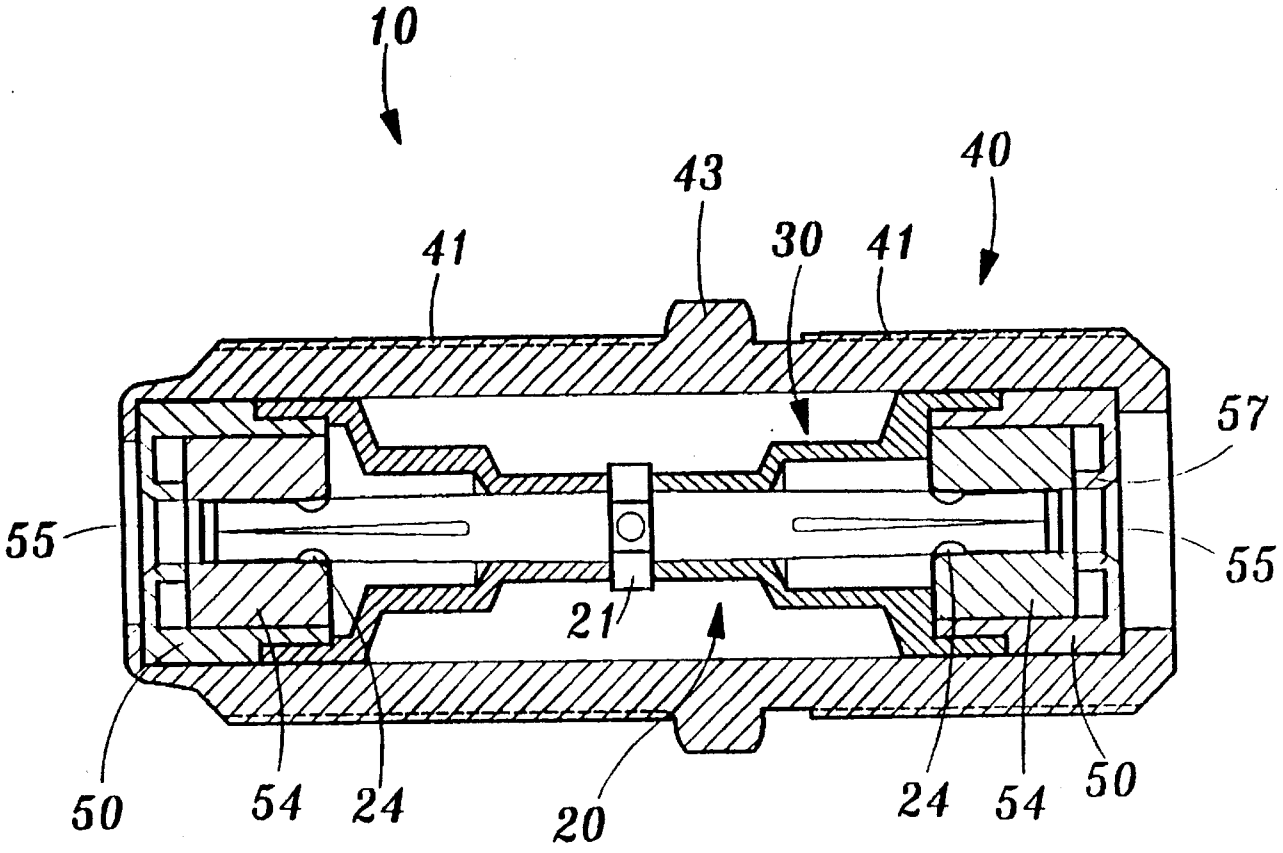
FIG. 5 is a sectional view taken along line 4—4 of FIG. 2.
Figure 5A:
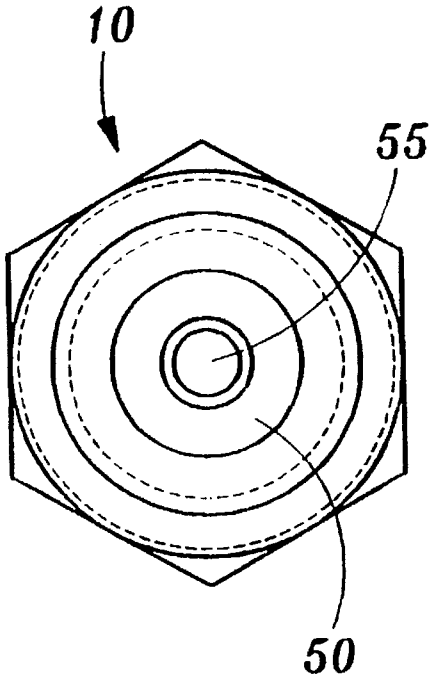
FIG. 5A is a side view according to FIG. 2.

Please now refer to FIG. 4. When the two insulating members 53 are respectively inserted into two ends of the contact member 20, the smaller diameter ends 31 of the insulating sleeves 30 will abut against the projecting wings 21 of the contact member 20 and bind the ends thereof. The larger diameter ends 32, 56 of the insulating sleeves 30 and insulating caps 50 will snugly plug the inner passages 44 of two ends of the main body 40. Then, the contact member 20 and two insulating members 53 are further secured in the main body 40 in riveting manner. When the cable conductor is inserted into the contact portions 23 of the contact member 20 through the opening 55, by means of the projecting sections 24, the cable conductor electrically contacts with the contact member 20. Meanwhile, the stretching ability of the cable conductor is limited by the resilient member 52 and thus a better contacting effect with respect to coaxial cable with cable conductors having different diameters can be achieved.

Please refer to Attachments 1 and 2 which respectively show the test data of a real sample of the present invention and a real sample of the conventional connector, wherein within some ranges, the return loss of the conventional connector is several times that of the present invention. Therefore, it is known that the present invention has better application effect, especially within the over 550 MHz high frequency range. In addition, the present invention is suitable for cable conductors with different dimensions.

Figure 6:
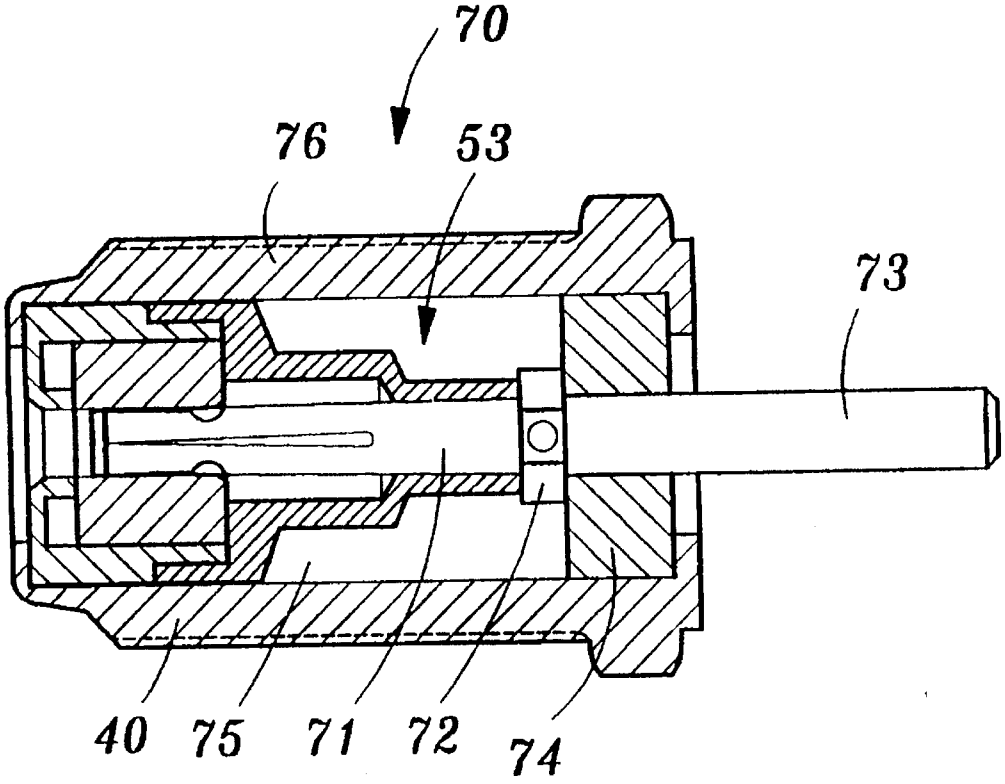
FIG. 6 is a sectional view of a second embodiment of the present invention.
Figure 6A:
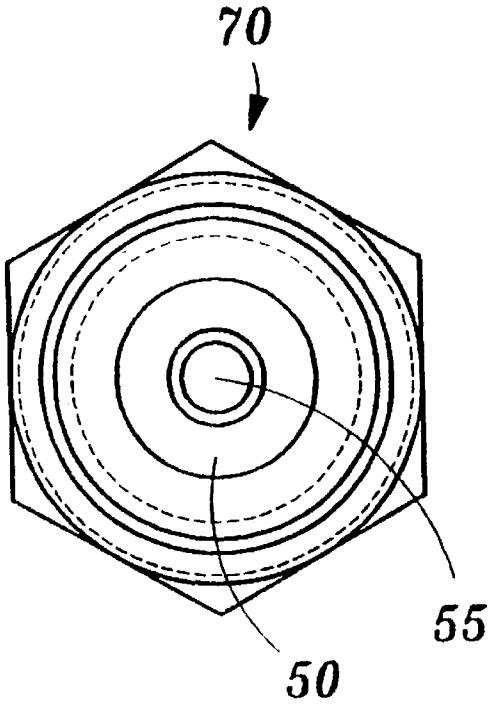
FIG. 6A is a side view according to FIG. 5.

Please refer to FIG. 6 and 6A which show a second embodiment of the connector 70 of the present invention. The structure thereof is substantially identical to that of the aforesaid embodiment except the main body 76 and contact member 71. The main body 76 is a one-side member and a connecting pin member 73 extends from one side of the projecting wing 72 of the contact member 71. In addition, an insulating filling member 74 is used to plug the inner passage 75 of the main body 40 for fixing the insulating member 53 at a central position, so that the pin member 73 is able to connect with a circuit board (pc board or other circuits) to input or output signal and improve the quality thereof.

Figure 7:
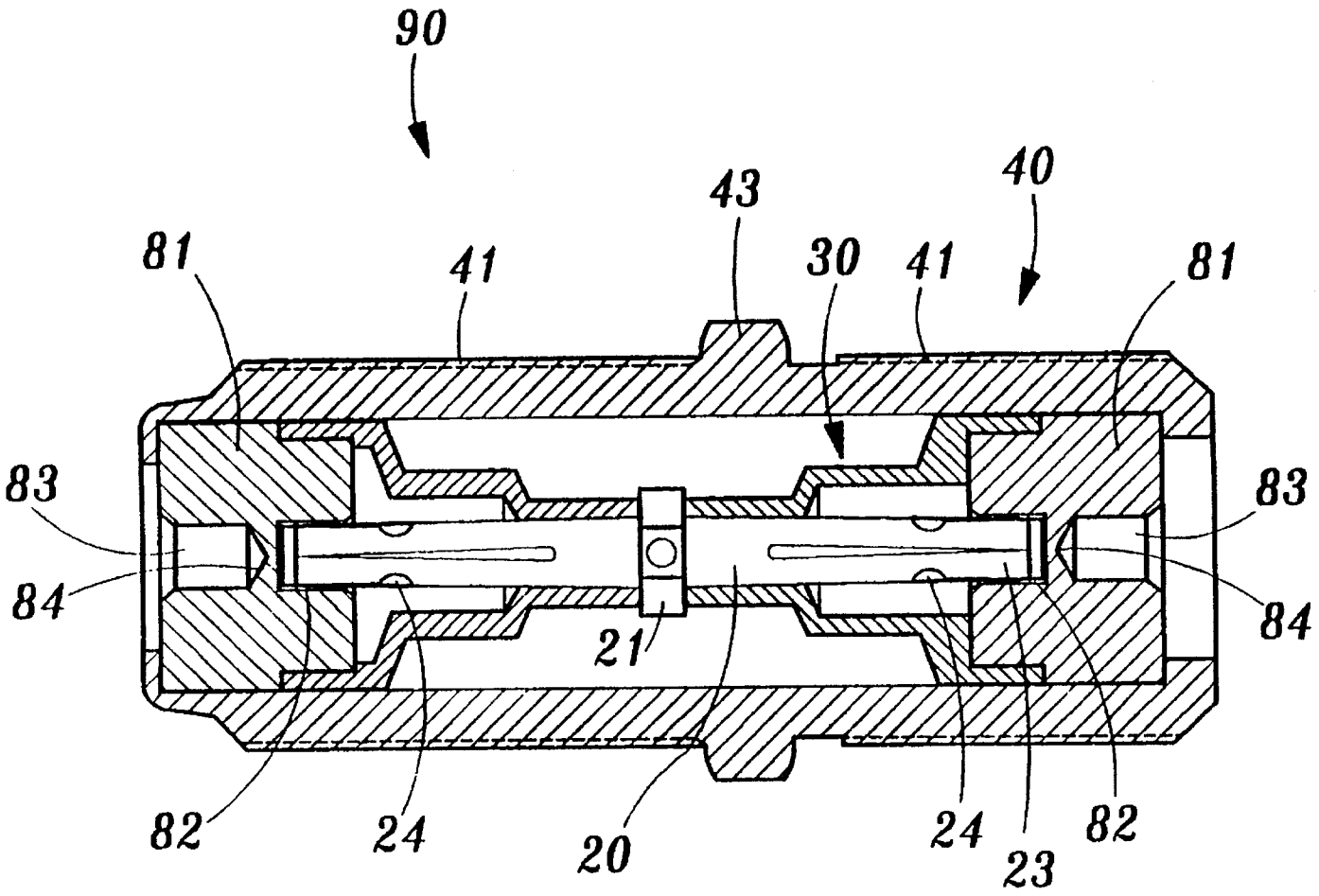
FIG. 7 is a sectional view of a third embodiment of the present invention.
Figure 8:
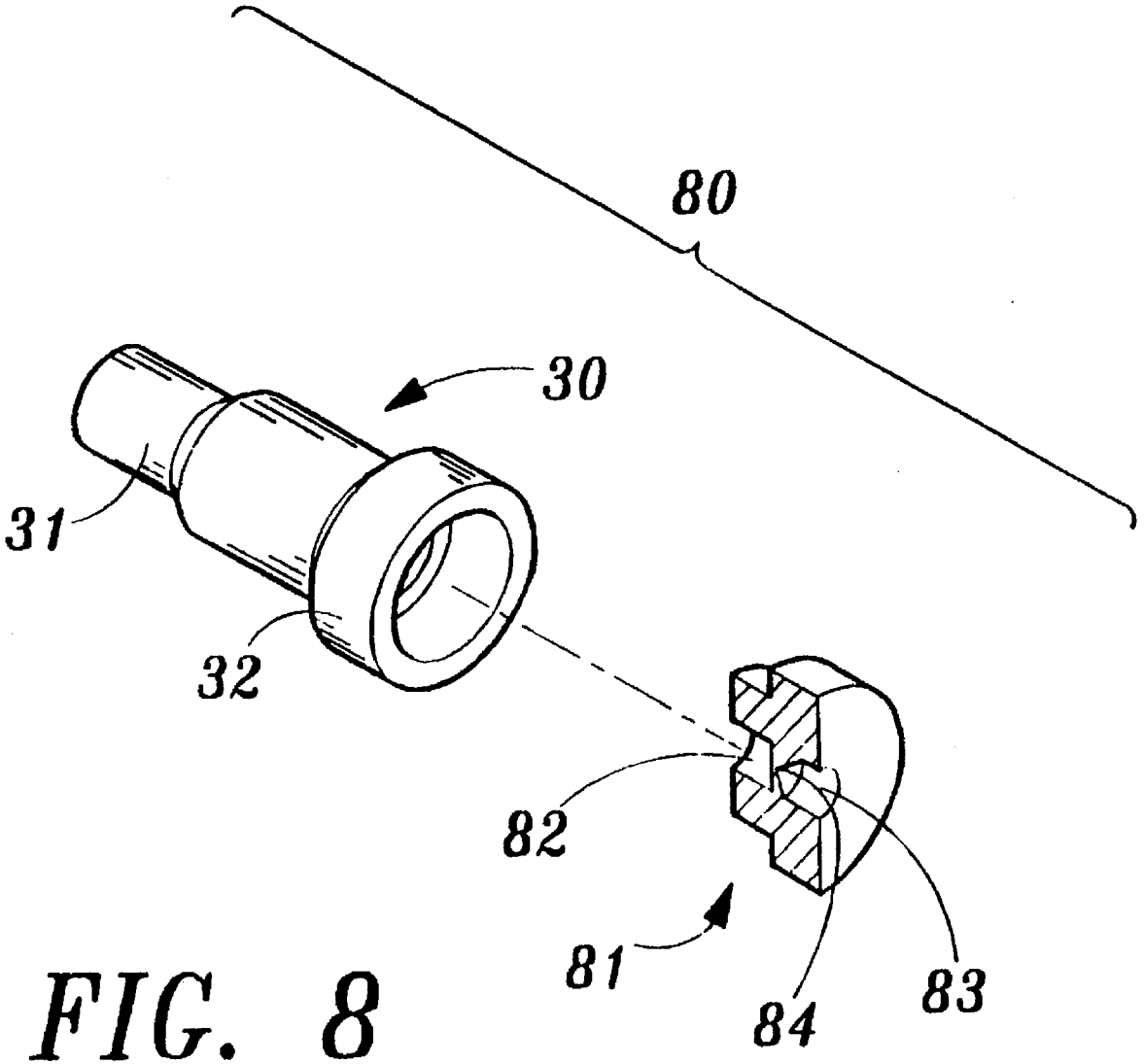
FIG. 8 is an exploded view of the third embodiment of the insulating member of the present invention.

Please refer to FIGS. 7 and 8 which show a third embodiment of the connector 90 of the present invention. The connector 90 has a structure substantially identical to that of the first embodiment except the insulating member 80. The insulating member 80 is waterproof, including an insulating sleeve 30 and a resilient member 81, wherein the resilient member 81 is made of silicone and has a two-stage shape. An axial hole 82 is formed at one end of the resilient member 81 for inserting one end of the contact member 20 thereinto. An opening 83 is formed at the other end of the resilient member 81. The opening 83 has a conic bottom 84 which is slightly separated from the axial hole 82, whereby when the cable conductor is inserted into the opening 83, the cable conductor will stab through the conic bottom 84 and extend into the contact portions 23 of the contact member 20.

It is to be understood that the above description and drawings are only used for illustrating one embodiment of the present invention, not intended to limit the scope thereof. Any variation and derivation from the above description and drawings should be included in the scope of the present invention.

What is claimed is:

1. A coaxial cable connector comprising:

a main body formed with inner passage;

a contact member received in said main body, having a symmetrical structure, a pair of projecting wings being formed on a middle section of said contact member, four slots being formed on each sleeve-like end of said contact member, said slots dividing said sleeve-like end of said contact member into four contacting portions, an inward projecting section being formed near a tail end of each contact portion;

an insulating member fitted with said contact member, said insulating member being composed of an insulating sleeve, a resilient member and an insulating cap, wherein said insulating sleeve is a three-stage hollow cylindric member, and said resilient member is made of silicone material and is sleeve-shaped, a central axial through hole being formed on said resilient member, said insulating cap being a two-stage hollow cylindric member and formed with a central axial opening, an inner flange being formed on inner side of said opening, whereby said resilient member is placed into said insulating cap with one side of said resilient member abutting against said inner flange, and then the assembled insulating cap and resilient member are placed into a larger diameter end of said insulating sleeve in such a manner that a smaller diameter end of said insulating cap is placed into said larger diameter end of said insulating sleeve to form a combination.

2. A connector as claimed in claim 1, wherein said main body is a one-side member and a connecting pin member extends from one side of said projecting wing of said contact member, and an insulating filling member plugging said inner passage of said main body for fixing said insulating member at a central position.

3. A connector as claimed in claim 1, wherein said insulating member includes an insulating sleeve and a resilient member, wherein said resilient member is made of silicone and has a two-stage shape, an axial hole being formed at one end of said resilient member for inserting one end of said contact member thereinto, an opening being formed at the other end of said resilient member, said opening having a conic bottom which is slightly separated from said axial hole, whereby when the cable conductor is inserted into said opening, the cable conductor stabs through said conic bottom and extends into said contact portions of said contact member.

* * * * *